US005833241A

United States Patent [19]

Araujo et al.

[11] Patent Number: 5,833,241

[45] Date of Patent: Nov. 10, 1998

[54] METHOD OF PROPELLING A DISC FROM BETWEEN A USER'S LEGS

[76] Inventors: Tony J. Araujo; Manny C. Rebelo, both of 81 Breman Lane, Mississauga, Ontario, Canada, L5M 1G7

[21] Appl. No.: 744,041

[22] Filed: Sep. 6, 1996

[51] Int. Cl.[6] ..... A63B 67/00

[52] U.S. Cl. ..... 273/317; 124/79; 473/518

[58] Field of Search ..... 273/317, 440, 273/459, DIG. 19; 124/79; 473/516, 518, 588, 589, 615, 505

[56] References Cited

U.S. PATENT DOCUMENTS

| | | | |
|---|---|---|---|
| 3,467,381 | 9/1969 | Kreiss | 124/79 X |
| 4,003,575 | 1/1977 | Hobbs | 273/DIG. 19 X |
| 4,203,592 | 5/1980 | Quatkemeyer | 273/336 |
| 4,290,226 | 9/1981 | Stauffer | 473/588 X |
| 4,955,842 | 9/1990 | Marcotti | 446/46 |
| 5,056,797 | 10/1991 | Huckert et al. | 273/402 |
| 5,110,139 | 5/1992 | Baumgartner | 273/400 |
| 5,116,275 | 5/1992 | Sassak | 446/48 |
| 5,123,655 | 6/1992 | Rones | 273/346 |

*Primary Examiner*—William H. Grieb

[57] ABSTRACT

The present invention relates to a method of propelling a disc from a user's legs which involves the following steps. Providing a string in the form of a closed loop through which a positions his or her legs. Providing a disc with a peripheral edge and positioning this disc within the loop. Winding the disc and loop together in a manner which creates tension between the disc and the user's knees. Releasing the disc and moving one's legs apart one another in a manner to unwind the loop and propel the disc from between the user's legs.

4 Claims, 3 Drawing Sheets

FIG 1
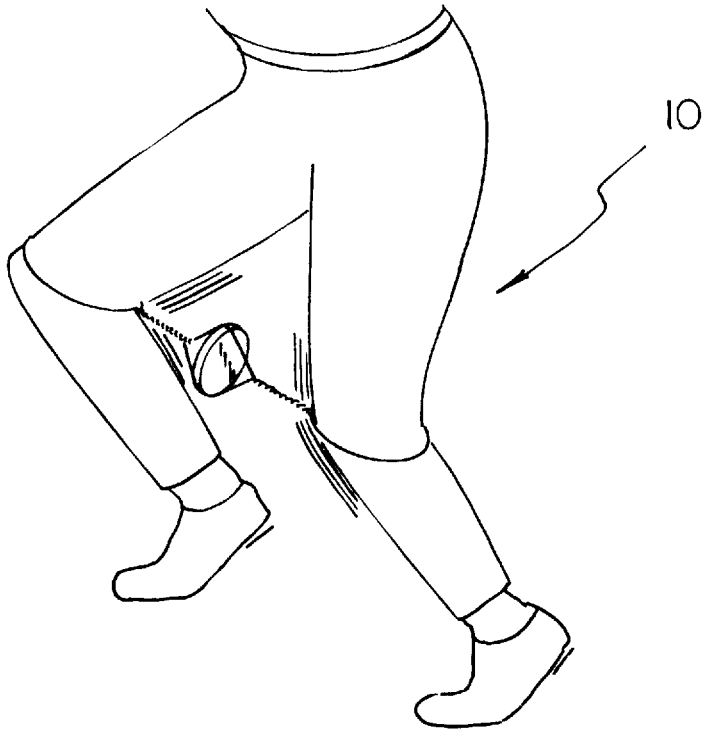
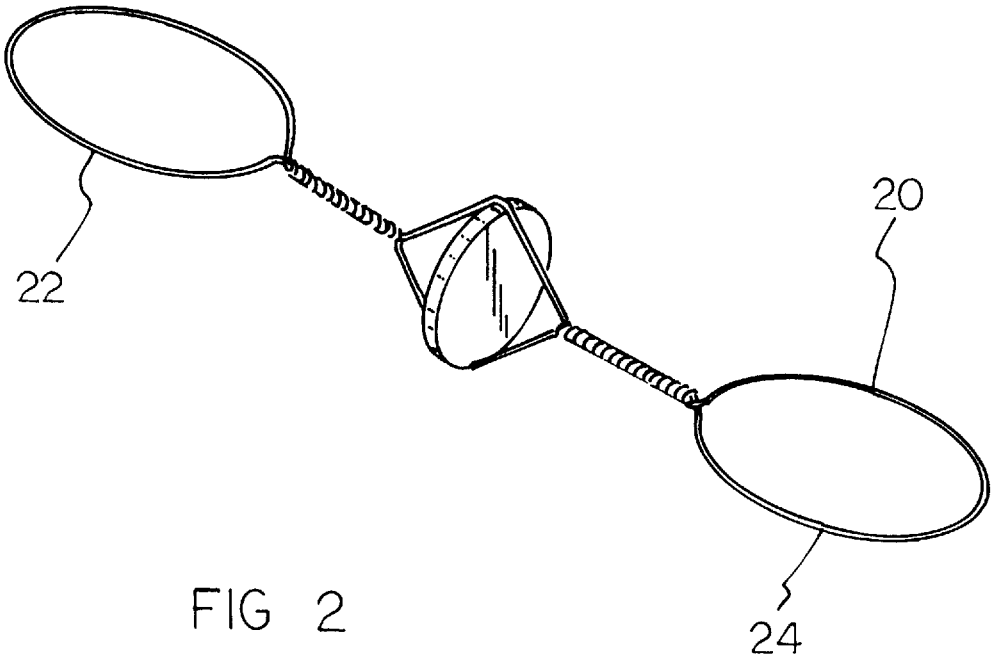
FIG 2

FIG 5
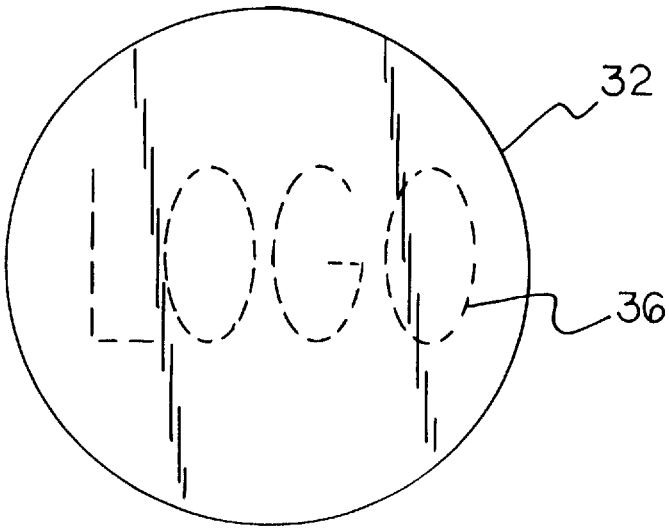
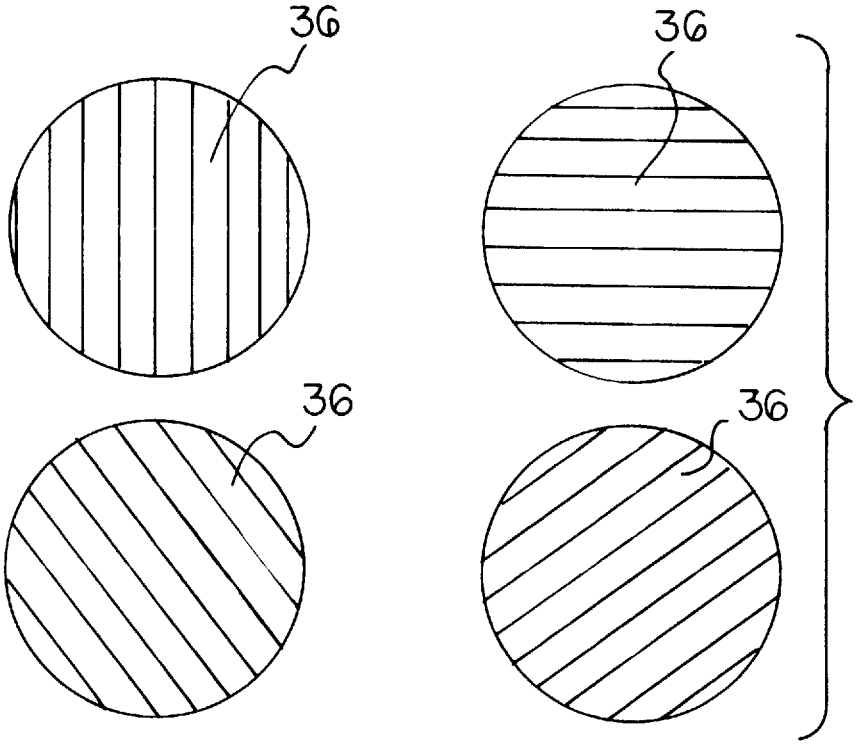
FIG 6

METHOD OF PROPELLING A DISC FROM BETWEEN A USER'S LEGS

BACKGROUND OF THE INVENTION

1. Field of the Invention

The present invention relates to method of propelling a disc from between a user's legs and more particularly pertains to a method of propelling a disc from between a user's legs and a competitive game employing such method.

2. Description of the Prior Art

The use of tossing and catching games is known in the prior art. More specifically, tossing and catching games heretofore devised and utilized for the purpose of create competition are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,123,655 to Rones illustrates a sailing disc and catch game comprising a pair of sticks and a disc.

U.S. Pat. No. 5,116,275 to Sassak discloses a tossable flying disc capable of being used as a tossing toy or twirled around a finger.

U.S. Pat. No. 5,110,139 to Baungartner disclose a disc tossing game consisting of a plurality of game pieces that are tossed at a receptacle.

U.S. Pat. No. 5,056,797 to Hockert; U.S. Pat. No. 4,203,592 to Quatkemeyer; U.S. Pat. No. 4,955,842 to Marcotti; and U.S. Pat. No. 3,919,990 to Polonyi each disclose various games and/or toys.

In this respect, the method of propelling a disc from between a user's legs according to the present invention substantially departs from the conventional concepts and designs of the prior art, and in doing so provides an apparatus primarily developed for the purpose of propelling a disc from between a user's legs and a competitive game employing such method.

Therefore, it can be appreciated that there exists a continuing need for new and improved method of propelling a disc from between a user's legs which can be used for propelling a disc from between a user's legs and a competitive game employing such method. In this regard, the present invention substantially fulfills this need.

SUMMARY OF THE INVENTION

In view of the foregoing disadvantages inherent in the known types of tossing and catching games now present in the prior art, the present invention provides an improved method of propelling a disc from between a user's legs. As such, the general purpose of the present invention, which will be described subsequently in greater detail, is to provide a new and improved method of propelling a disc from between a user's legs and method which has all the advantages of the prior art and none of the disadvantages.

To attain this, the present invention essentially comprises a method of propelling a disc from between a user's legs. The method comprising the following steps. Providing a string in the form of a closed loop with the loop having a first end, a second end and an intermediate extent therebetween. Positioning a user's legs within the loop such that one of the user's knees is adjacent the first end of the loop and the other of the user's knees is adjacent the second end of the loop. Providing a disc having two sides with a peripheral edge extending therebetween with the peripheral edge having roughened surface. The disc having indicia formed upon its first and second sides. Positioning the disc within the loop between the user's legs such that the roughened surface of the disc contacts both the forward string portion and the rearward string portion of the intermediate extent. Unwinding the disc such that there is no relative movement between the disc and the forward string portion and there is no relative movement between the disc and the rearward string portion. Releasing the disc while the user moves their knees away from one another in a manner to unwind the loop and propel the disc from between one's legs.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved method of propelling a disc from between a user's legs which have all the advantages of the prior art tossing and catching games and none of the disadvantages.

It is another object of the present invention to provide new and a improved method of propelling a disc from between a user's legs which may be easily and efficiently manufactured and marketed.

It is further object of the present invention to provide a new and improved method of propelling a disc from between a user's legs which are of durable and reliable constructions.

An even further object of the present invention is to provide a new and improved method of propelling a disc from between a user's legs which are susceptible of a low cost of manufacture with regard to both materials and labor, and which accordingly are then susceptible of low prices of sale to the consuming public, thereby making such method of propelling a disc from between a user's legs economically available to the buying public.

Still yet another object of the present invention is to provide a new and improved method of propelling a disc from between a user's legs which provide in the apparatuses and methods of the prior art some of the advantages thereof, while simultaneously overcoming some of the disadvantages normally associated therewith.

Even still another object of the present invention is providing a method of propelling a disc from between a user's legs and a competitive game employing such method.

Lastly, it is an object of the present invention to provide a new and improved method of propelling a disc from a user's legs which involves the following steps. Providing a string in the form of a closed loop through which a positions his or her legs. Providing a disc with a peripheral edge and positioning this disc within the loop. Winding the disc and loop together in a manner which creates tension between the disc and the user's knees. Releasing the disc and moving one's legs apart one another in a manner to unwind the loop and propel the disc from between the user's legs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the method of propelling a disc from between a user's legs constructed in accordance with the principles of the present invention.

FIG. 2 is a perspective view of the string and disc in accordance with the present invention.

FIG. 5 is a view of the disc with its indicia.

FIG. 6 is a view of various color and design schemes for use on the disc.

The same reference numerals refer to the same parts through the various Figures.

DESCRIPTION OF THE PREFERRED EMBODIMENT

Figure 3:
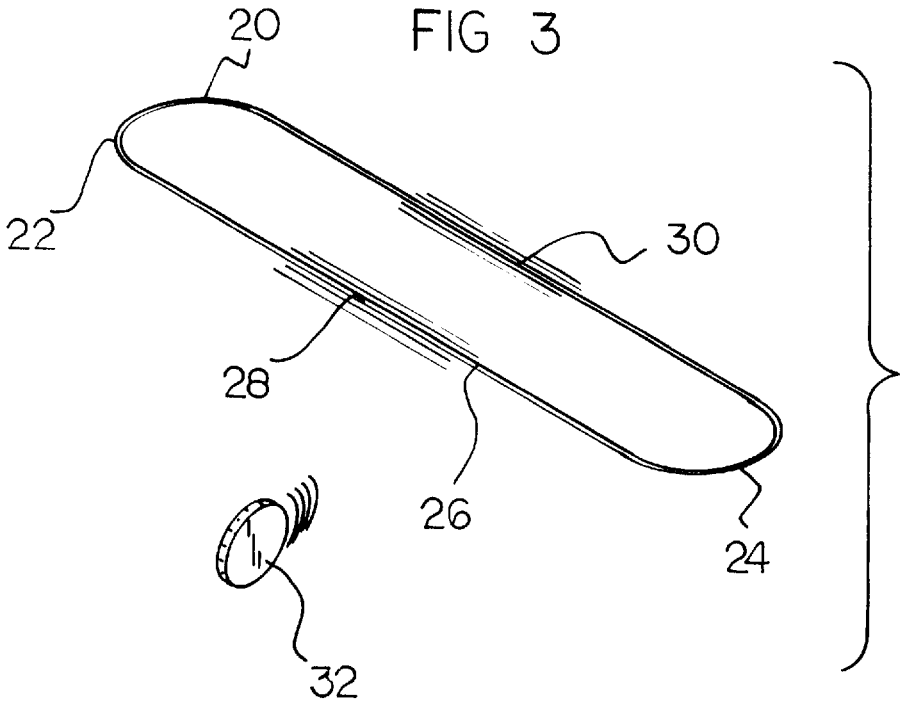
FIG. 3 is a view of the string and disc with the disc being propelled from the string.
Figure 4:
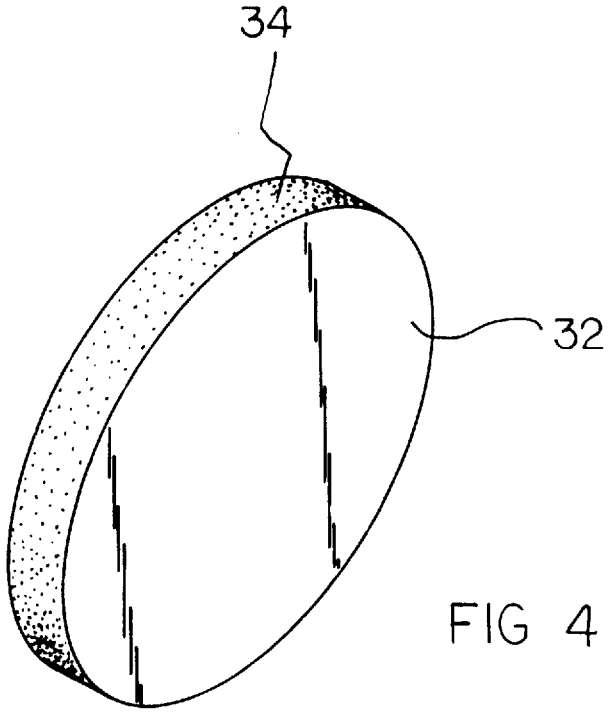
FIG. 4 is a view of the disc with its roughened peripheral edge.

With reference now to the drawings, and in particular to FIG. 1 thereof, the preferred embodiment of the new and improved method of propelling a disc from between a user's legs embodying the principles and concepts of the present invention and generally designated by the reference numeral 10 will be described.

The present invention relates to a method of propelling a disc from between a user's legs. In its broadest context, the method includes the steps of providing a string in the form of a closed loop; positioning a user's legs within the loop such that a user's first knee is adjacent one end of the loop and a user's second knee is adjacent the opposite end of the loop; providing a disc having a peripheral edge and positioning the disc within the loop between a user's legs; winding the disc and the loop between a user's legs and releasing the disc while moving the user's knees away from one other in a manner to unwind the loop and propel the disc forward. The details to the various steps of the present method will be described in greater detail hereinafter.

The string 20 which is employed in the present method can be constructed from a conventional cloth material or, in the alternative, can be constructed from a resilient rubber material. In any case, the string 20 is formed in a closed loop, or when the loop is defined by a first end 22, a second end 24 with an intermediate extent 26 therebetween. This intermediate extends 26 is further defined by a forward string portion 28 and a rearward string portion 30. The dimensions of the string should be such to enable a user of average height and build to position their legs within the loop and afford tension to the loop by spreading their knees.

In the second step of the method, a user positions their legs within the loop such that one of their knees is adjacent the first end of the loop 22 while their other knee is adjacent the opposite end of the loop 24. Again, the user keep his or her knees apart to ensure tension through the string 20.

In the third step of the method, a disc 32 is provided. This disc 32 is defined by a first side and a second side and a peripheral edge 34 which extends therebetween. This peripheral edge 34 is formed from a roughened surface. The function of this roughened surface will be described in greater detail hereinafter. For decorative purposes indicia 36 can be formed upon the first and second sides of the disc. This indicia can take any one of a variety of forms. As indicated in FIG. 5, this indicia may take the form of a company logo. Furthermore, as indicated in FIG. 6, this indicia can take the form of various colors or designs. These colors and designs can be such that when the disc is rotating various visual effects are created. The fourth step of the method involves the positioning of the disc 32 within the loop of the string 20. The disc 32 is positioned such that its peripheral edge, and roughened surface, contact both the forward string portion 28 and the rearward string portion 30 of the intermediate extent 26 of the string 20.

In the fifth step of the method the disc and the corresponding string portions are wound together.

Namely, the disc 32 is wound such that there is no relative movement between the disc 32 and the forward strung portion 28, likewise, the disc is wound such that there is no relative movement between the disc 32 and the rearward string portion 30. Winding the disc in this fashion creates a corresponding tension, between the disc and the user's first knee as well as between the disc and the user's second knee, noted in FIG. 1 and FIG. 2.

The final step of this method involves releasing the disc from between the user's knees. In this step the user, after the winding step is completed, releases the disc and moves their knees away from one another. In this manner, the tension that was created between the disc and the user's first knee as well as the tension between the disc and the user's second knee causes the disc to spin when the loop is unwound. After the loop is completely unwound, the disc is propelled from between the user's legs.

The present method can also take the form of a game wherein two participants standing next to one another simultaneously wind their perspective discs and launch their respective discs from between their legs. The winner of this competition would be the person who propelled their disc the farthest and/or completed the task in the shortest amount of time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved method for propelling a disc from between a user's legs, the user employing their knees to propel the disc, the method comprising the following steps:

providing a string in the form of a closed loop, the loop having a first end and a second end and an intermediate extent therebetween, the intermediate extent having a forward string portion and a rearward string portion;

positioning a user's legs within the loop such that one of the user's knees is adjacent the first end of the loop and the other of the user's knees is adjacent is the second end of the loop, keeping the user's knees apart to ensure tension throughout the string;

providing a disc having a first side and a second side and peripheral edge extending therebetween, the peripheral edge having a roughened surface, indicia formed upon the first and second sides of the disc;

positioning the disc within the loop between the user's legs such that the roughened surface of the disc contacts both of the forward string portion and the rearward string portion of the intermediate extent;

winding the disc such that there is no relative movement between the disc and the forward string portion and there is no relative movement between the disc and the rearward string portion; and releasing the disc while the user moves their knees away from one another in a manner to unwind the loop and propel the disc from between the user's legs.

2. A method for propelling a disc, the method comprising:

providing a string in the form of a closed loop, the loop having a first end and a second end and an intermediate extent therebetween, the intermediate extent having a forward string portion and a rearward string portion;

positioning a user's legs within the loop such that one of the user's knees is adjacent the first end of the loop and the other of the user's knees is adjacent is the second end of the loop, keeping the user's knees apart to ensure tension throughout the string;

providing a disc having a first side and a second side and peripheral edge extending therebetween;

positioning the disc within the loop between the user's legs such that the peripheral edge of the disc contacts both of the forward string portion and the rearward string portion of the intermediate extent;

winding the disc such that there is no relative movement between the disc and the forward string portion and there is no relative movement between the disc and the rearward string portion; and releasing the disc while the user moves their knees away from one another in a manner to unwind the loop and propel the disc from between the user's legs.

3. The method as described in claim 2 wherein:

the peripheral edge has a roughened surface to enable greater contact between the peripheral edge and forward string portion and the rearward string portion.

4. The method as described in claim 2 wherein:

indicia is formed upon the first and second sides of the disc.

* * * * *